US006588813B1

(12) United States Patent
Marcarini et al.

(10) Patent No.: US 6,588,813 B1
(45) Date of Patent: Jul. 8, 2003

(54) VEHICLE DOOR HANDLE

(75) Inventors: Massimo Marcarini, Castiglione Torinese (IT); Fiorenzo Savant, Collegno (IT)

(73) Assignee: Valeo Sicurezza Abitacolo S.p.A, Via Asti (IT)

( * ) Notice: Subject to any disclaimer, the term of this patent is extended or adjusted under 35 U.S.C. 154(b) by 0 days.

(21) Appl. No.: 09/432,394

(22) Filed: Nov. 2, 1999

(30) Foreign Application Priority Data

Nov. 3, 1998 (IT) ..... TO98A0926

(51) Int. Cl.[7] ..... E05B 1/00

(52) U.S. Cl. ..... 292/347; 292/348; 292/336.3; 70/439; 70/276; 70/277

(58) Field of Search ..... 292/347, 348, 292/336.3; 70/439, 276, 277

(56) References Cited

U.S. PATENT DOCUMENTS 5,682,135 A * 10/1997 Labonde ..... 360/426
5,844,470 A * 12/1998 Garnault et al. ..... 180/287
6,034,617 A * 3/2000 Luebke ..... 340/825.31
6,042,159 A * 3/2000 Spitzley et al. ..... 16/111.1
6,075,294 A * 6/2000 Van den Boom et al. . 307/10.1
6,089,649 A * 7/2000 Hamada et al. ..... 296/155
6,093,978 A * 7/2000 Benard et al. ..... 307/10.1
6,152,321 A * 11/2000 Staar ..... 221/17
6,163,971 A * 12/2000 Humphries, Jr. et al. ..... 33/515
6,218,933 B1 * 4/2001 Josserand et al. ..... 340/426
6,234,041 B1 * 5/2001 Larabet et al. ..... 74/523
6,236,333 B1 * 5/2001 King ..... 340/825.31
6,239,693 B1 * 5/2001 Benard et al. ..... 296/146.7
6,343,140 B1 * 1/2002 Brooks ..... 348/156
6,367,295 B1 * 4/2002 Agostini et al. ..... 307/10.1
6,392,607 B1 * 5/2002 Gold et al. ..... 343/713
6,397,136 B1 * 5/2002 Breed et al. ..... 180/273

FOREIGN PATENT DOCUMENTS

| | | |
|---|---|---|
| DE | 19617038 | 11/1997 |
| DE | 19633894 | 2/1998 |
| DE | 19752974 | 9/1998 |
| EP | 0955431 | 11/1999 |

* cited by examiner

*Primary Examiner*—Robert J. Sandy
*Assistant Examiner*—Matthew E. Rodgers
(74) *Attorney, Agent, or Firm*—Liniak, Berenato and White

(57) ABSTRACT

A handle for a vehicle door has a control lever hinged to a connecting structure for connection to the door, and a detecting assembly for detecting the presence of a user's hand about to open the door; the detecting assembly having a magnetic aerial, which is housed inside the lever to detect the variation in a magnetic field caused by the user's hand nearing the handle, and is connected by a sliding connection to a circuit carried by the connecting structure and which supplies a presence signal to a control unit for releasing the respective lock upon reading an identification code carried by the user.

18 Claims, 3 Drawing Sheets

VEHICLE DOOR HANDLE

The present invention relates to a vehicle door handle.

More specifically, the present invention relates to a handle of the type comprising a connecting structure for connection to the vehicle door; a user-gripped lever hinged to the connecting structure; and a presence detecting device for detecting the presence of the user's hand close to the lever, and supplying a relative presence signal to a control unit, which, in response to the signal, and after reading, in known manner, an identification code carried by the user, sets the various locks to a safety-off mode.

BACKGROUND OF THE INVENTION

Known presence detecting devices normally comprise an infrared-ray device in turn comprising a beam emitter normally fitted to the connecting structure, and a receiver carried by the lever. When the lever is gripped by the user, the beam is cut off, causing the detecting device to emit the presence signal.

Comprising components particularly sensitive to external agents, known presence detecting devices have the drawback of requiring constant cleaning and maintenance to ensure perfect light emission/reception, and may possibly supply the control unit with false presence signals, thus resulting in undesired release of the lock safety devices.

Moreover, known detecting devices are relatively expensive to both produce and assemble, on account of the component parts having to be located in given relative positions and, in many cases, being highly sensitive to the shock produced by slamming of the doors.

SUMMARY OF THE INVENTION

It is an object of the present invention to provide a vehicle door handle designed to eliminate the aforementioned drawbacks, and which, in particular, provides for a high degree of efficiency and reliability, and is easy to manufacture.

According to the present invention, there is provided a handle for a vehicle door, comprising a connecting structure for connection to a supporting body; a movable control member carried by said connecting structure and activated, in use, by the hand of a user; and detecting means for detecting the presence of said hand on said movable control member, and emitting a presence signal; characterized in that said detecting means comprise magnetic sensing means associated with at least one of said connecting structure and said movable control member to detect the variation in a magnetic field caused by the user gripping the movable control member.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
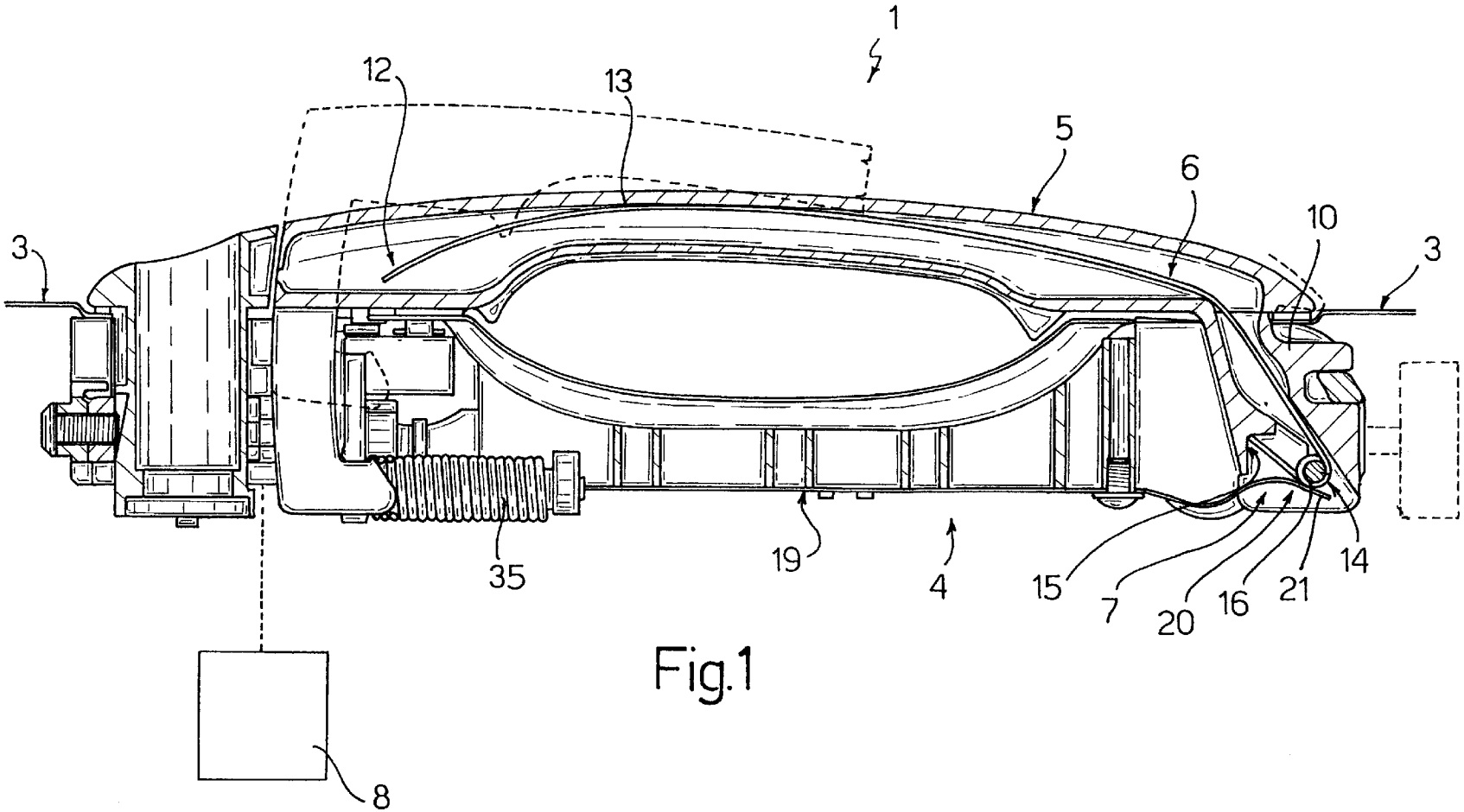
FIG. 1 shows a section of a preferred embodiment of the handle according to the present invention.

Number 1 in FIG. 1 indicates as a whole a handle for activating a lock (not shown) of a vehicle door 3.

Handle 1 comprises a connecting structure 4 for connection to door 3; and a hollow control lever 5 hinged to connecting structure 4 to rotate about an axis, and which, in use, is gripped manually by a user. Handle 1 also comprises a detecting assembly 6 for detecting the intention of the user to open the respective door. More specifically, assembly 6 comprises a magnetic device 7 for detecting the presence of the user's hand close to control lever 5, and for supplying a user-present signal to a known control unit 8—shown schematically in FIGS. 1 and 2—which, on receiving the signal, and after reading, in known manner, an identification code carried by the user, provides for setting the lock (not shown) to a safety-off mode enabling door 3 to be opened.

As shown, particularly in FIG. 1, detecting device 7 comprises a wire aerial 12 having a first portion 13 extending inside control lever 5, and a second end portion 14 housed inside a seat 15 on structure 4 and wound about a pin 16 connected integrally to structure 4 and extending parallel to the rotation axis of lever 5.

Figure 2:
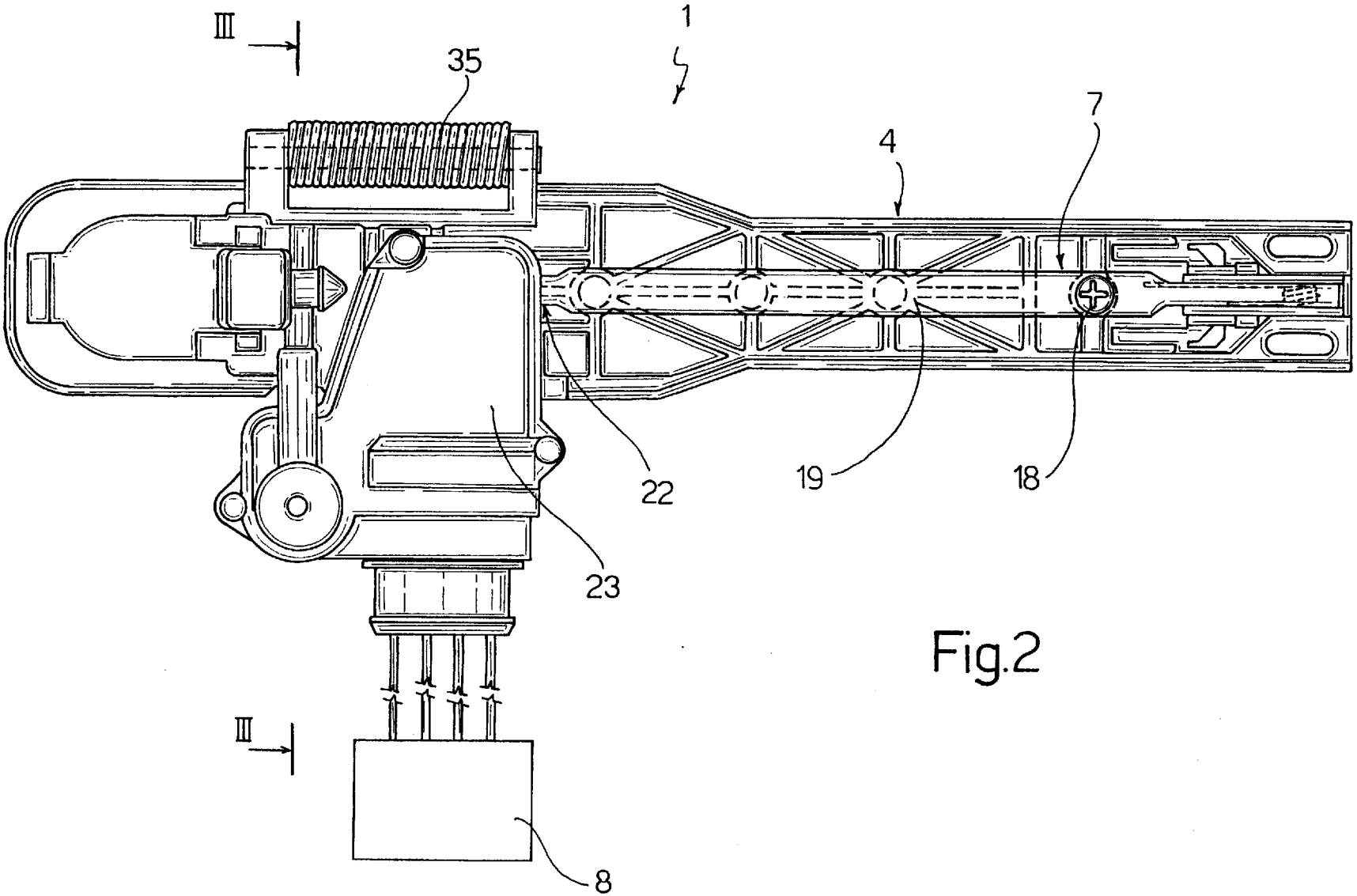
FIG. 2 shows an underside view of the FIG. 1 handle.

As shown in FIG. 1 and particularly in FIG. 2, structure 4 is also fitted, preferably by means of one or more screws 18, with a conducting member 19 in the form of a strip, conveniently a metal strip, which is connected to aerial 12 by a sliding connection 20. More specifically, member 19 has an end portion 21 facing pin 16 and cooperating in sliding manner with end portion 14 of aerial 12 wound about pin 16.

As shown in FIG. 2, at the opposite end to portion 21, strip member 19 has an end portion 22 connected in known manner to a known interface circuit (not shown), which is housed inside a cavity, on structure 4, closed by a cover 23, and provides, in use, for receiving a presence signal from aerial 12, and for supplying a corresponding signal to control unit 8.

Figure 3:
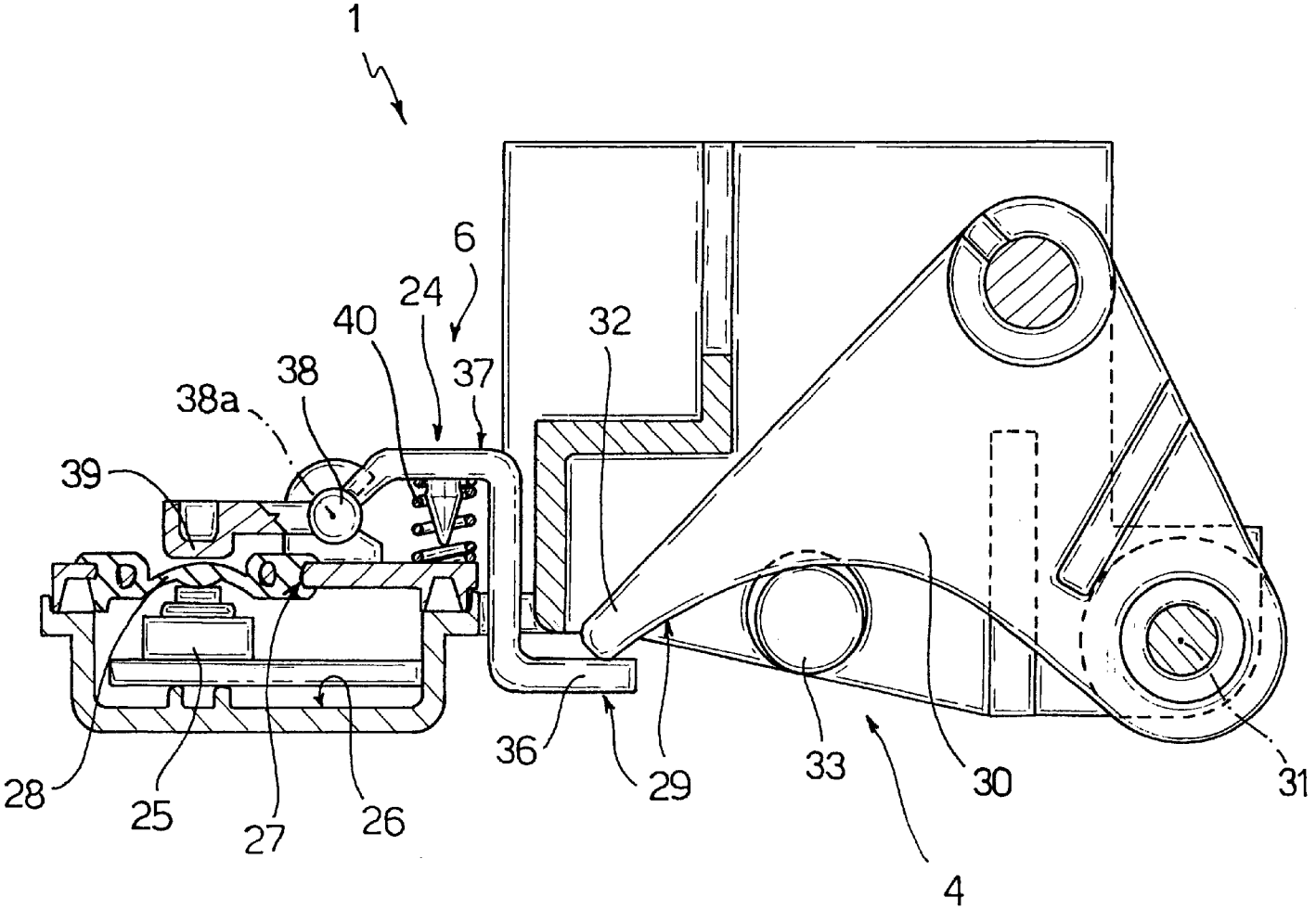
FIG. 3 shows a larger-scale section along line III—III in FIG. 2.

As shown in FIG. 3, assembly 6 also comprises a further electromechanical detecting device 24 in parallel with device 7, and which provides for detecting rotation of control lever 5 with respect to connecting structure 4, and supplying a signal to unit 8. More specifically, electromechanical device 24 comprises a pushbutton switch 25 housed inside a sealed chamber 26 formed in structure 4 and having an inlet opening 27 closed by a seal 28. Electromechanical device 24 also comprises a mechanical transmission 29 in turn comprising a known activating lever 30, an intermediate portion of which is hinged to structure 4 to rotate about an axis 31 perpendicular to pin 16, and an end portion 32 forced by a spring 35 against an appendix 33 integral with lever 5. Portion 32 rests on an end portion 36 of a rocker arm lever 37 for activating switch 25.

In the particular example described, rocker arm lever 37 comprises an intermediate portion 38 hinged to structure 4 to rotate about an axis 38*a* parallel to axis 31; and, at the opposite end to portion 36, an end portion 39 facing seal 28 to act directly on switch 25.

Portion 36 is maintained contacting lever 30 by a compression spring 40 compressed between connecting structure 4 and a portion of lever 37 extending between portions 36 and 38.

Handle 1 according to the present invention operates as follows.

As the user approaches the vehicle, a known aerial (not shown) reads, in known manner, an identification code carried by the user, and supplies unit 8 with a recognition signal to activate or alert unit 8. At this point, as the user's hand approaches handle 1, magnetic aerial 12 detects the variation in the magnetic field and supplies the interface circuit (not shown) with a signal via sliding connection 20 and strip member 19; the interface circuit in turn supplies a signal to control unit 8, which, in response, releases the various lock safety devices to enable the user to open the doors by turning respective levers 5.

In the event of a fault on magnetic device 7, electromechanical device 24 intervenes when control lever 5 is rotated by the user. More specifically, rotation of lever 5 into the open position rotates lever 30 clockwise, in FIG. 3, about respective axis 31, so that rocker arm lever 37 rotates anticlockwise, in FIG. 3, about axis 38*a*, and end portion 39 of lever 37 elastically deforms seal 28 to activate switch 25. Upon switch 25 being activated, the interface circuit supplies a signal to control unit 8, which releases the safety devices on the locks.

The advantages of handle 1 will be clear from the foregoing description.

In particular, by virtue of comprising a magnetic detecting device 7, i.e. capable of detecting the variation in a magnetic field caused by the presence of the user's hand, assembly 6 as described is obviously not only extremely straightforward to produce, but also provides for a consistently high degree of reliability and efficiency. Furthermore, providing an electromechanical device 24 in parallel with magnetic device 7 eliminates any problems caused by possible malfunctioning of magnetic device 7.

The efficiency and reliability of assembly 6 are further enhanced by detecting assembly 6 of the handle 1 described being fully insulated from external agents and not normally requiring maintenance or inspection.

Clearly, changes may be made to handle 1 as described and illustrated herein without, however, departing from the scope of the present invention. In particular, a magnetic detecting aerial other than the one described by way of example may be provided, and the same magnetic aerial may be connected to the connecting structure otherwise than as described. Furthermore, the magnetic aerial may be connected to the interface circuit by other than strip member 19, and pushbutton switch 25 may be activated by a mechanical transmission other than that described.

Moreover, switch 25 and respective mechanical transmission 29 of handle 1 described may be dispensed with.

Finally, switch 25 of handle 1 described may also be used to release the lock, in the event the lock is also released electrically like the safety device.

What is claimed is:

1. A handle (1) for a vehicle door (3), comprising a connecting structure (4) for connection to a supporting body; a movable control member (5) carried by said connecting structure (4) and activated, in use, by the hand of a user; and detecting means (6) for detecting the presence of said hand proximate to said movable control member (5), and for supplying a presence signal to an electronic control unit further executing interrogation of a data storage medium carried by the user; wherein said detecting means (6) comprise magnetic sensing means (12) associated with at least one of said connecting structure (4) and said movable control member (5) to detect the variation in a magnetic field caused by the user gripping the movable control member (5), wherein said sensing means (12) detects the variation in said magnetic field caused merely by a presence of the hand of the user proximate said movable control member (5), and wherein said sensing means includes a wire aerial at least partially disposed within said control lever.

2. A handle as claimed in claim 1, characterized in that said movable control member comprises a lever (5) hinged to said connecting structure (4) to rotate, with respect to the connecting structure (4), about a hinge axis; said magnetic sensing means (12) being at least partly housed in said lever (5).

3. A handle (1) for a vehicle door (3), comprising a connecting structure (4) for connection to a supporting body; a movable control member (5) carried by said connecting structure (4) and activated, in use, by the hand of a user; and detecting means (6) for detecting the presence of said hand proximate to said movable control member (5), and emitting a presence signal; wherein said detecting means (6) comprise magnetic sensing means (12) associated with at least one of said connecting structure (4) and said movable control member (5) to detect the variation in a magnetic field caused by the user gripping the movable control member (5), and wherein said magnetic sensing means comprise a first elongated metal member, said detecting means (6) also comprise transmitting means (19) for transmitting said presence signal and extending through said connecting structure (4); and connecting means (16, 20) for connecting said magnetic sensing means (12) to said transmitting means (19).

4. A handle as claimed in claim 3, characterized in that said connecting means (16, 20) comprise a supporting member (16) carried by said lever (5); said magnetic sensing means (12) being partly wound about said supporting member (16).

5. A handle as claimed in claim 3, characterized in that said connecting means (20) comprise a sliding connection.

6. A handle as claimed in claim 3, characterized in that said connecting means (20) comprise an intermediate portion of said first elongated metal member (12).

7. A handle as claimed in claim 6, characterized in that said transmitting means comprise a second elongated metal member (19) in turn comprising a portion (21) cooperating in sliding manner with the intermediate portion of said first elongated metal member (12).

8. A handle as claimed in claim 7, characterized in that said first elongated metal member (12) is a wire member, and said second elongated metal member (19) is a strip member.

9. A handle for a vehicle door (3), comprising a connecting structure (4) for connection to a supporting body; a movable control member (5) carried by said connecting structure (4) and activated, in use, by the hand of a user; and detecting means (6) for detecting the presence of said hand proximate to said movable control member (5), and emitting a presence signal; wherein said detecting means (6) comprise magnetic sensing means (12) associated with at least one of said connecting structure (4) and said movable control member (5) to detect the variation in a magnetic field caused by the user gripping the movable control member (5), and comprising further detecting means (24) for detecting displacement of the movable control member (5) with respect to the connecting structure (4).

10. A handle as claimed in claim 9, characterized in that said further detecting means (24) are located in parallel with said detecting means (6).

11. A handle as claimed in claim 10, characterized in that said further detecting means (24) comprise switch means (25); and a mechanical transmission (29) interposed between the movable control member (5) and said switch means (25) to activate said switch means (25).

12. A handle as claimed in claim 11, characterized in that said mechanical transmission (29) comprises at least a first rocker arm lever (37).

13. A handle as claimed in claim 12, characterized in that said first rocker arm lever (37) comprises an intermediate portion (38) hinged to said connecting structure (4); an end portion (39) which acts on said switch means (25); and an opposite end portion (36) resting on an activating member (30) associated with said movable control member (5).

14. A handle as claimed in claim 13, characterized in that said mechanical transmission (29) also comprises elastic means (40) interposed between said rocker arm lever (37) and said connecting structure (4) to keep said opposite end portion (36) resting constantly on said activating member (30).

15. A handle as claimed in claim 13, characterized in that said switch means (25) are housed inside a sealed chamber (26) formed in said connecting structure (4).

16. The handle according to claim 1, wherein said sensing means detects the variation in said magnetic field caused merely by a presence of the hand of the user proximate said movable control member.

17. The handle according to claim 16, wherein said sensing means includes a wire aerial at least partially disposed within said control lever.

18. A handle in combination with a vehicle door, said combination comprising:

a connecting structure in connection with a supporting body;

a movable control member carried by said connecting structure and activated, in use, by a hand of a user; and a detection mechanism to detect the presence of said hand of said user proximate said movable control member, wherein said detection mechanism includes a magnetic sensing mechanism which detects a variation in a magnetic field caused merely by the presence of said hand of said user proximate said movable control member, wherein said sensing mechanism includes a wire aerial at least partially disposed within said control lever.

* * * * *